US006120671A

United States Patent [19]

Karner et al.

[11] Patent Number: 6,120,671

[45] Date of Patent: Sep. 19, 2000

[54] METHOD AND APPARATUS FOR ELECTROLYTIC PICKLING A METALLIC STRIP

[75] Inventors: Wilhelm Karner, Schöffelstrasse; Jovan Starcevic, Rossackgasse, both of Austria

[73] Assignee: Andritz-Patentverwaltungs-Gesellschaft m.b.H., Graz, Austria

[21] Appl. No.: 08/957,155

[22] Filed: Oct. 24, 1997

[30] Foreign Application Priority Data

Oct. 25, 1996 [AT] Austria ..... A 1872/96

[51] Int. Cl.[7] ..... C25D 5/00

[52] U.S. Cl. ..... 205/147; 205/82; 205/705; 204/206; 204/211

[58] Field of Search ..... 205/147, 148, 205/335, 349, 138, 152, 81, 82, 83, 84, 705; 204/198, 206, 211

[56] References Cited

U.S. PATENT DOCUMENTS

| | | | |
|---|---|---|---|
| 821,622 | 5/1906 | Edison | 205/712 |
| 3,557,336 | 1/1971 | Bullough et al. | 219/71 |
| 3,970,537 | 7/1976 | Froman et al. | 204/211 |
| 4,118,302 | 10/1978 | Gobert | 204/206 |
| 4,363,709 | 12/1982 | Zaremski | 204/145 R |
| 4,434,040 | 2/1984 | Brendlinger | 204/206 |
| 4,526,688 | 7/1985 | Podrini | 204/206 |
| 4,769,114 | 9/1988 | Podrini | 204/28 |
| 5,236,566 | 8/1993 | Tsuchiya et al. | 204/206 |

*Primary Examiner*—Kathryn Gorgos
*Assistant Examiner*—Wesley A. Nicolas

[57] ABSTRACT

A system and method is provided for electrolytic pickling a metal strip, where the electric current is conducted through the strip indirectly without electrically conductive contact between the strip and the electrodes. The strip is run vertically or substantially vertically through the process, and the electrolyte liquid is fed in between the strip and the electrodes.

23 Claims, 3 Drawing Sheets

METHOD AND APPARATUS FOR ELECTROLYTIC PICKLING A METALLIC STRIP

BACKGROUND OF THE INVENTION

1. Field of the Invention

The invention relates to a method and corresponding apparatus for electrolytic pickling a metallic strip, such as a stainless steel, titanium, aluminum or nickel strip, in which electric current is conducted through the strip indirectly without any electrically conductive contact between the strip and the electrodes which induce the current.

2. Description of the Related Art

In conventional systems for pickling cold-rolled stainless steel strips, a so-called "neutral electrolyte" process is used, in which a voltage is induced indirectly in the strip with no points of contact existing between any conductor rolls and the strip. In the conventional system, the anodes and cathodes used to induce the voltage are mounted horizontally in the pickling cell, and completely covered with electrolyte liquid.

For example, as shown in FIG. 1, in a conventional tank 1, a metal strip 2 is guided through the electrolyte 3 (e.g., $Na_2SO_4$) between the cathodes 4 and anodes 5. The spacing between the electrodes and the strip is usually between approximately 70 and 150 mm, with the strip usually showing a certain amount of sag which can be reduced by inserting supporting rolls, for example, in the center of the plant. A pump 7 feeds the electrolyte 3 through a pipe 6 into the pickling tank 1. The electrolyte 3 is drained off through a pipe 8 and fed into a storage tank 9, for example, from where the electrolyte 3 is then recirculated.

A conventional process for electrolytic galvanizing a strip is described in published Austrian patent application no. AT-PS 373 922. In this process, the electrodes are mounted vertically, and electrolytic liquid is fed into the gap between the anode electrodes and the strip. However, a voltage is induced directly in the strip, with the conductor rollers acting as the cathodes.

A method for pickling a stainless steel strip at higher current densities is described in U.S. Pat. No. 4,363,709 to Zaremski. Although the patent describes a method which provides current densities of 40–60 A/dm$^2$, the patent does not give any details on the equipment with which such current densities could be realized in a large-scale plant within a reasonable voltage range (less than 40 volts).

Accordingly, a continuing need exists for an effective method for pickling or galvanizing a metal strip by indirectly inducing a voltage in the metal strip.

SUMMARY OF THE INVENTION

An object of the present invention, therefore, is to provide a method an apparatus for electrolytic pickling or galvanizing a metal strip, such as a stainless steel, titanium, aluminum or nickel strip, by indirectly inducing a voltage in the metal strip in a manner to maintain a high current density in the metal strip.

To substantially achieve this object, the present invention provides a method and corresponding apparatus for electrolytically pickling or galvanizing a metal strip by running the strip vertically or substantially vertically past anodes and cathodes which are mounted vertically or substantially vertically, while feeding electrolyte liquid between the strip and the anode and cathode electrodes. The apparatus includes a device which can alter the spacing between the anodes and cathodes to suit the size of the strip to insure that maximum current yield is achieved at the lowest possible voltage for any strip size.

The apparatus further is capable of controlling the amount of electrolyte liquid being fed into the gap between the electrodes and the strip. The anode and cathode electrodes also can be located in an offset arrangement, and the spacing between the anode and cathode electrodes can be controlled. The distance between the electrodes and the strip can also be adjusted to account for any waviness in the strip.

These and other objects and advantages of the invention will become more apparent and more readily appreciated from the following detailed description of the presently preferred exemplary embodiments taken in conjunction with the accompanying drawings.

BRIEF DESCRIPTION OF THE DRAWINGS

Referring now to the attached drawings which form part of the original disclosure.

DETAILED DESCRIPTION OF THE PREFERRED EMBODIMENTS

Figure 2:
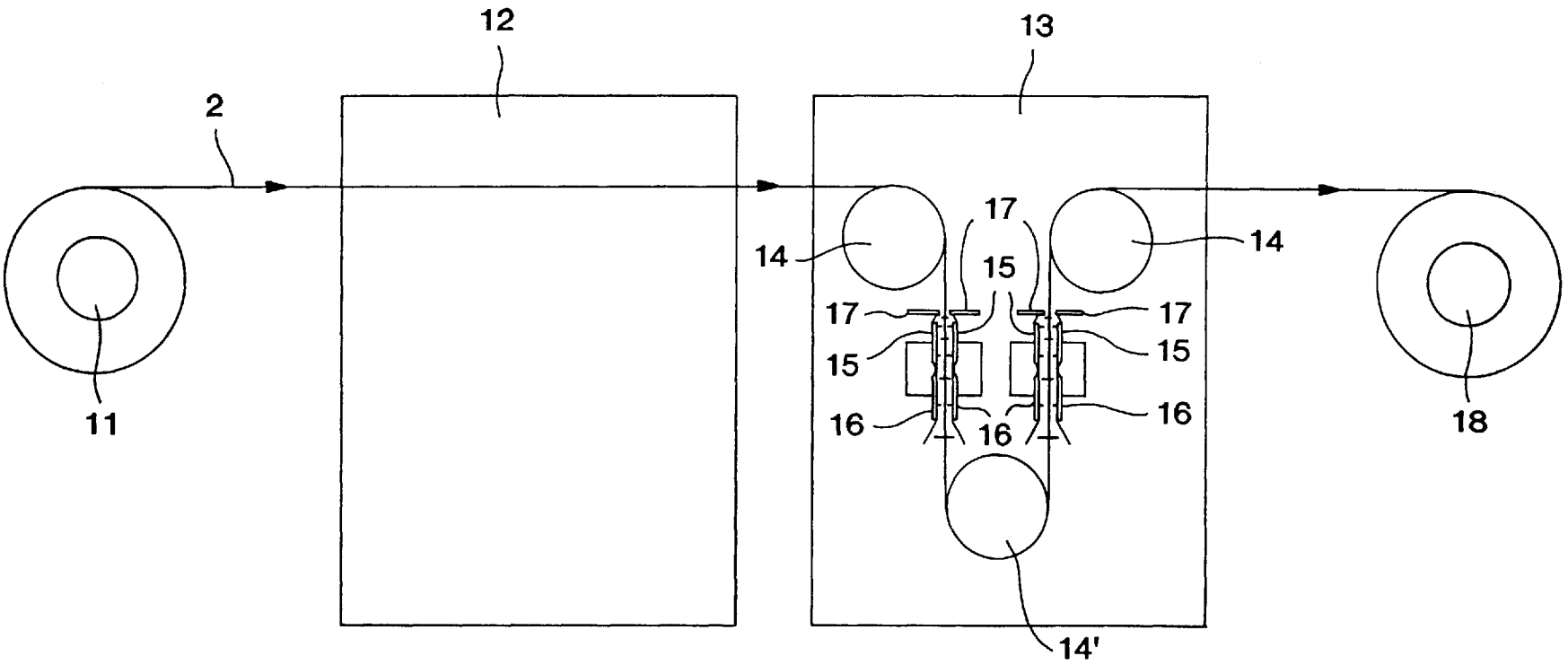
FIG. 2 illustrates an example of a plant for electrolytic pickling a strip according to an embodiment of the invention.
Figure 3:
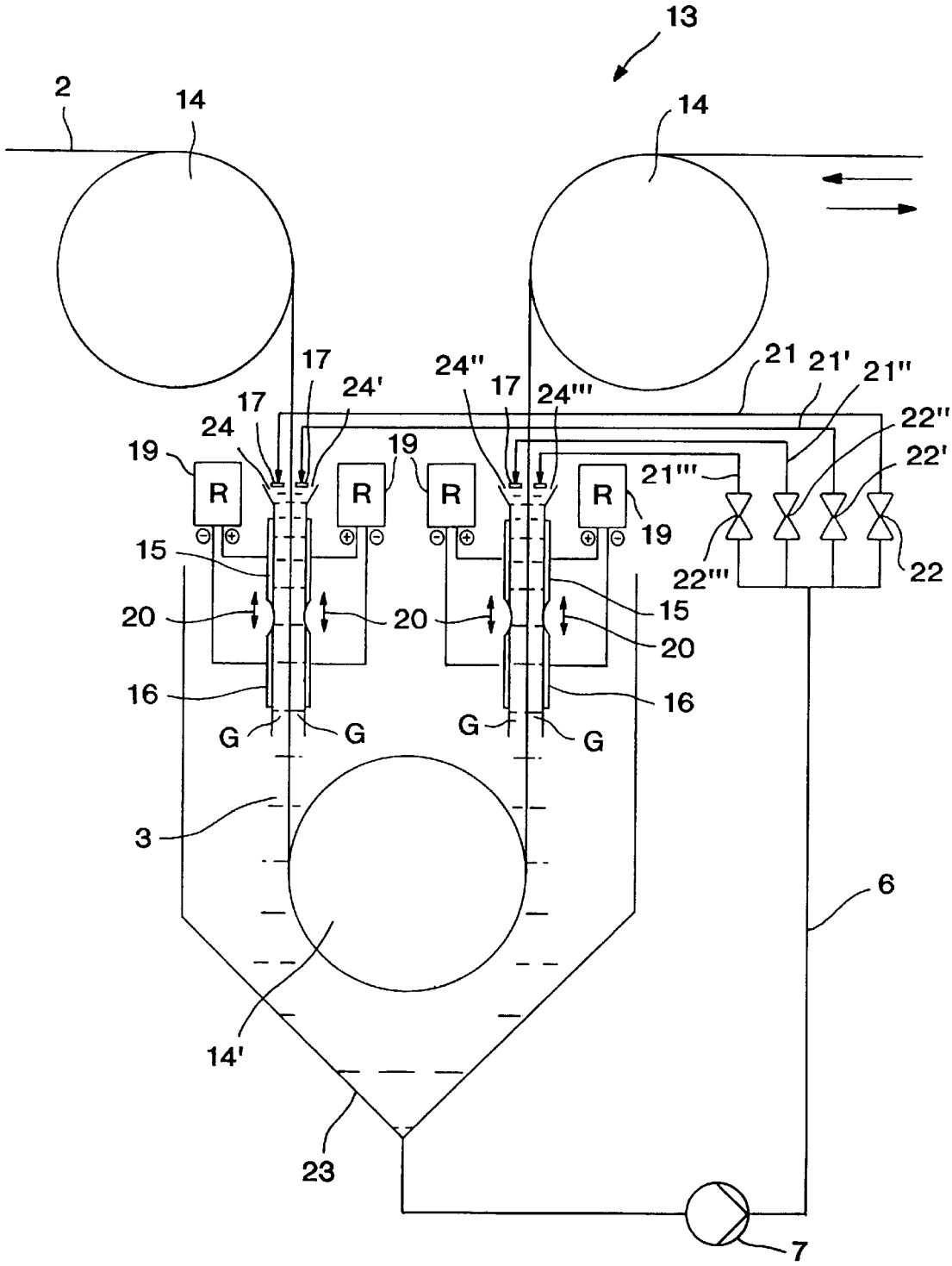
FIG. 3 illustrates an embodiment of a cell of the plant shown in FIG. 2.

FIGS. 2 and 3 illustrate an example of a system according to an embodiment of the invention, that includes a decoiler 11 and a recoiler 18 which pull a strip 2 through a treatment plant at a speed of up to 60 m/min. The treatment plant comprises chemical degreasing unit 12, which cleans the lubricated strip 2, and an electrolytic cell 13. As shown in FIG. 3 specifically, the cell 13 is connected to four rectifiers 19. Each rectifier has a maximum rating of 3000 A/32V. The arrangement of the electrodes 15 and 16 is selected such that only one anode of an anode electrode pair (15) and one cathode of a cathode electrode (16) pair is connected to one rectifier.

The electrode anode and cathode electrodes are located in an offset arrangement in the strip running direction, so that the strip 2 runs between two anode electrodes mounted opposite one another, and two cathode electrodes mounted opposite one another. This results in an even flow of current at the strip end and thus, achieves even pickling.

The surface of an anode electrode or the entire anode electrode can be made preferably of lead or lead alloys, iridium oxide or graphite. The material of the anode electrode results in chemical passivation in the presence of anodic attack by the electrolyte anions. Preferably, lead is used with sulfate ions ($SO_4$) and iridium oxide with sulfate and/or chloride ions ($Cl^-$). In addition, graphite can also be used with different anions or mixtures thereof.

Due to the vertical arrangement of the anode and cathode electrode pairs, much space is saved in the apparatus. The space required is approximately 2 m, as opposed to 8 m needed for conventional plants. In addition, good strip guiding is achieved because there is little or no sag in the strip during conveyance.

As further shown in FIG. 3, the metal strip 2, which is stainless steel for example, is deflected over rollers 14 and 14' and fed into the gaps G between the electrode pairs 15 and 16. In this example, electrode pairs 15 are anodes and electrode pairs 16 are cathodes. As shown, each electrode in a pair is connected to one rectifier 19. The electrodes (e.g., the cathodes 16) can be moved along the direction marked by arrow 20, to adjust the spacing between the anode electrode pair 15 and cathode electrode pair 16. This permits optimum use of the electric power.

Specifically, adjustable spacing between the anode electrodes and cathode electrodes permit adjustment of the current flow through the strip and as a result, a reduction in energy costs. Also, the apparatus can include a device which sets the gap between the strip and the electrode. With this device, the spacing can easily be adapted to the waviness of the strip. A device which is connected to the setting device for the electrodes detects strip waviness. This avoids contact between the strip and the electrodes which could lead to short-circuiting.

Moreover, the spacing between anode electrodes 15 and cathode electrodes 16 can be altered to suit the strip dimension. This ensures that the maximum current yield is achieved at the lowest voltage for different strip dimensions. For example, if the anode and cathode are mounted too close to each other, a direct current flow results in the strip. On the other hand, as the spacing between the anode and cathode electrodes increases, the voltage drop in the strip rises. This drop in voltage is linked to the cross-sectional dimension of the strip. Accordingly, an optimum spacing exists for each strip size, and the device which adjusts the spacing between the anode and cathode electrodes attempts to set the spacing at the optimum amount for the size of the strip.

The invention is also capable of controlling the amount of electrolyte being fed into the gap between the electrodes and the strip. By doing this, the strip can be stabilized hydraulically exactly in the center between the electrodes. Thus, the spacing between the electrodes and the strip can be reduced to a minimum. The spacing between any of the electrodes and the strip can be, for example, anywhere between 5 and 15 mm, or could also be up to 150 mm, if desired. The spacing can be any practical value as would be appreciated by one skilled in the art.

Specifically, a pump 7 transports the electrolyte through a pipe 6, and pipes 21, 21', 21" and 21'", which then feed the electrolyte 3 through inlets 17 into the gaps 24, 24', 24" and 24'", respectively, between the electrodes 15 and 16 and the strip 2. The amount of electrolyte liquid fed in can be adjusted to the conditions required by control devices 22, 22', 22" and 22'", which control the flow of electrolyte through pipes 21, 21', 21" and 21'", respectively. After passing between the electrodes, the electrolyte liquid 3 is collected in the lower section 23 of the electrolytic cell 13 and then fed back to the pump 7.

With this arrangement, the flow can be adapted to suit the strip width, and it can also be set to an optimum level for a strip with varying widths. With the resulting hydraulic strip guiding, the strip can be guided carefully between the electrodes. Conventional plants usually require two rectifiers for each cell—one for the lower and one for the upper side of the strip. In the cell according to the invention, one rectifier can be installed for one or for several cells. Due to the hydraulic strip guiding made possible by controlling the amount of electrolyte fed in, the upper side of the strip, for example, can be pushed closer to the electrodes if it has more scale than the lower side and thus, pickled more intensively.

The temperature and concentration of the electrolyte and the loading density (coulomb per unit of area) can also be set specifically to suit the strip to be pickled. In other words, the temperature and concentration of the electrolyte can be set based on a characteristic of the strip. For instance, the concentration of an electrolyte, such as $Na_2SO_4$, in the electrolyte liquid can be a value within a range between 100 and 350 g/l, such as about 150 g/l. Also, the temperature of the electrolyte liquid can be set at a temperature range between 20 and 85° C., or simply below 70° C. By doing so, the pickling conditions can be set at an optimum for each strip dimension, plant speed, treatment time, type of scale, and so on. The loading densities are typically between 20 $A/dm^2$ and 250 $A/dm^2$, for example. The loading density is approximately 130 $A/dm^2$ for lead anodes, and approximately 180 $A/dm^2$ for iridium anodes.

Figure 1:
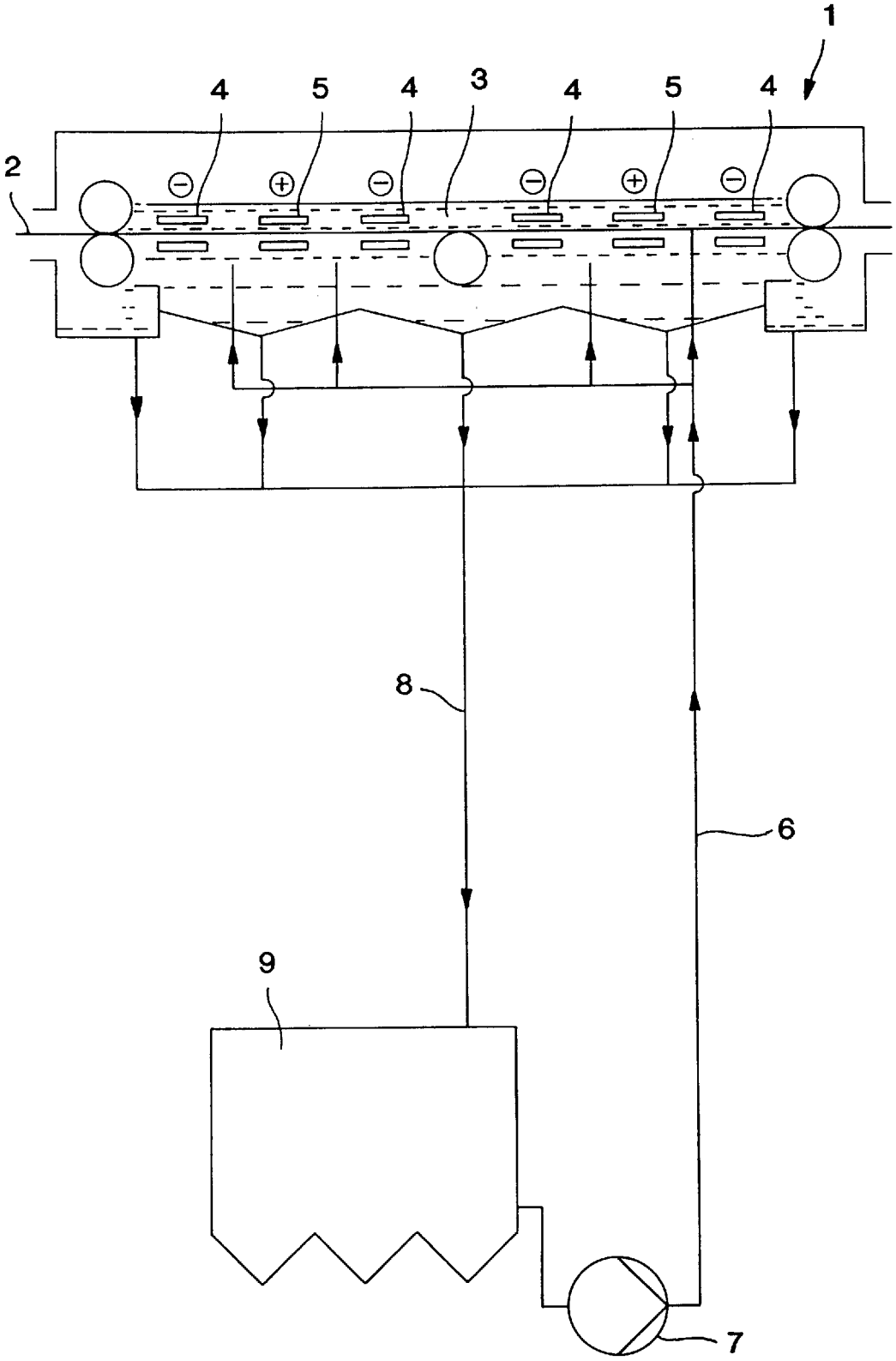
FIG. 1 PRIOR ART
FIG. 1 illustrates a conventional pickling plant which uses a neutral electrolyte.

The new cell yields a higher performance than conventional cells. At the same electrical energy input, more current can be conducted through the strip since there is less drop in voltage. At the same time, however, the flow mechanics of the new cell have been designed to achieve very high mass and heat transfer figures. This results from the high degree of turbulence, caused by the small gap between the electrodes and the heat from the reaction zone being carried off very effectively. The cell of the present invention flooded cell provides better strip guiding and a higher level of mass and heat transfer than the flooded cell of the conventional system shown in FIG. 1, which results in better pickling performance. The rectifiers in conventional cells have a rating of 11000 A (2×5500). Depending on the spacing between the electrodes and the strip (approx. 50–150 mm), the drop in voltage is between 25 and 40 V in the conventional cells. However, the cell according to the invention can transfer 50000 A to the strip at approximately 17 V.

A pilot plant was constructed in accordance with the present invention to test the process of the present invention. The plant arrangement contained one decoiler 11 and one recoiler 18 which pull the strip 2 through the treatment plant at a speed of up to 60 m/min. The pilot treatment plant comprises a chemical degreasing unit 12 to clean the lubricated strip and an electrolytic cell 13. The cell 13 is connected to four rectifiers 19. Each rectifier has a maximum rating of 3000 A/32V. The arrangement of the electrodes was selected such that only one anode 15 and cathode 16 pair is connected to one rectifier 19. The spacing between the electrodes was set manually.

A coil of annealed, cold-rolled stainless steel strip was treated with this plant arrangement.

Material: A1S1 304

Thickness: 0.5 mm

Width: 320 mm

Coil Weight: 1000 kg

The rectifier output was increased at a constant plant speed of approx. 50 m/min. At a power input of 6000 A (4×1500 A), the strip 2 was completely free of scale. At a power input of 8000 A, the strip surface showed improved brightness. At a current density of approx. 200 A/dm, the electrolyte did not overheat in the cell, the strip did not overheat and the gas removal was adequate. In the analysis of the tests, the power input was also determined to be uniform. This was achieved by measuring the brightness and color. The tests showed that the fluctuations were no greater than in the initial material. The strip edges with heavier scaling were also completely descaled.

The invention is not limited to the configurations described above. On the contrary, all known variations of electrode wiring and arrangement, such as appropriate polarization, or shorter anodes and longer cathodes to boost chemical treatment, can be used in the system described above.

What is claimed is:

1. A method for electrolytic pickling a metallic strip, comprising the steps of:

conducting electric current through the strip indirectly without electrically conductive contact between the strip and electrodes which induce the electric current, the electrodes comprising at least one anode and at least one cathode disposed on the same side of the metal strip;

passing the strip by the electrodes in a substantially vertical direction while feeding electrolyte liquid between the strip and the electrodes; and altering the spacing between the at least one anode and the at least one cathode in accordance with the size of the strip.

2. A method according to claim 1, further comprising the step of controlling the amount of electrolyte liquid being fed into the gap between the electrodes and the strip.

3. A method according to claim 1, further comprising the step of setting the temperature of the electrolyte liquid based on a characteristic of the strip.

4. A method according to claim 3, wherein the temperature of the electrolyte liquid is set at one of the following temperature ranges:

between 20 and 85° C.; or below 70° C.

5. A method according to claim 1, further comprising the step of setting the concentration of the electrolyte liquid based on a characteristic of the strip.

6. A method according to claim 5, wherein a concentration of $Na_2SO_4$ in the electrolyte liquid is at one of the following concentrations:

between 100 and 350 g/l; or about 150 g/l.

7. A method according to claim 1, further comprising the step of setting the loading density based on a characteristic of the strip.

8. A method of according to claim 7, wherein the loading density is one of the following:

between 20 $A/dm^2$ and 205 $A/dm^2$;

approximately 130 $A/dm^2$ for lead anodes; or approximately 180 $A/dm^2$ for iridium anodes.

9. A method according to claim 1, further comprising the step of altering the gap between the electrodes and the strip.

10. A method according to claim 1, further comprising the steps of:

measuring the strip waviness; and moving the electrodes away from the strip based on the measured waviness to avoid contact between the strip and the electrodes.

11. A method as claimed in claim 1, wherein:

the electrodes comprise a plurality of said anodes and cathodes arranged in electrode pairs, each comprising one of the anodes and one of the cathodes, at least two of the electrode pairs being disposed on opposite sides of the strip; and the passing step passes the strip between said at least two of the electrode pairs.

12. A method as claimed in claim 1, wherein:

the conducting step conducts the current through the metal strip along a direction of movement of the metal strip.

13. A system for electrolytic pickling a metallic strip, comprising:

a current device comprising electrodes, including at least one anode and at least one cathode disposed on the same side of the metal strip, being adapted to conduct electric current through the strip indirectly without electrically conductive contact between the strip and the electrodes;

a conveyor for conveying the strip in a substantially vertical direction past the electrodes such that a gap exists between the electrodes and the strip;

a device which is adapted to feed electrolyte liquid into the gap; and an electrode position adjuster which is adapted to set and control spacing between the at least one anode and the at least one cathode based on the size of the strip.

14. A system according to claim 13, wherein the electrodes comprise at least one anode and cathode which are disposed in an offset arrangement to one another.

15. A system according to claim 14, wherein the surface of the anode or the entire anode includes lead, lead alloys, iridium oxide or graphite.

16. A system according to claim 13, further comprising at least one control device which controls the electrolyte liquid feed.

17. A system according to claim 16, wherein a separate said control device exists for each liquid channel between the strip and a said electrode.

18. A system according to claim 13, further comprising a device which is adaptable to set the gap between the strip and the electrodes.

19. A system according to claim 18, further comprising a device which is coupled to the setting device to detect strip waviness.

20. A system according to claim 13, wherein the electrodes and the strip are spaced at a distance between 5 and 15 mm from one another.

21. A system as claimed in claim 13, wherein:

the electrodes comprise a plurality of said anodes and cathodes arranged in electrode pairs, each comprising one of the anodes and one of the cathodes, at least two of the electrode pairs being disposed on opposite sides of the strip.

22. A system as claimed in claim 21, wherein:

the conveyor is adapted to convey the metal strip between said at least two electrode pairs.

23. A system as claimed in claim 13, wherein:

the current device is adapted to conduct the current through the metal strip along a direction of movement of the metal strip.

* * * * *